United States Patent [19]

Benson

[11] 3,946,469

[45] Mar. 30, 1976

[54] POLYESTER FIBERS AND TOWS

[75] Inventor: Richard W. H. Benson, Charlotte, N.C.

[73] Assignee: Imperial Chemical Industries Limited, London, England

[22] Filed: Nov. 8, 1973

[21] Appl. No.: 414,051

Related U.S. Application Data

[63] Continuation of Ser. No. 295,635, Oct. 6, 1972, abandoned, which is a continuation of Ser. No. 100,489, Dec. 21, 1970, abandoned, which is a continuation-in-part of Ser. No. 776,656, Nov. 18, 1968, abandoned.

[52] U.S. Cl. ..... 28/72.14

[51] Int. Cl.[2] ..... D02G 1/12

[58] Field of Search ..... 28/1.6, 72.14

[56] References Cited

UNITED STATES PATENTS

| | | | |
|---|---|---|---|
| 2,575,838 | 11/1951 | Rainard | 28/72.14 X |
| 2,854,701 | 10/1958 | Rainard | 28/1.6 |
| 3,120,692 | 2/1964 | Crawford et al. | 28/1.6 X |
| 3,353,222 | 11/1967 | Keel et al. | 28/1.6 |
| 3,353,239 | 11/1967 | Heinnis | 28/1.6 |

*Primary Examiner*—Louis K. Rimrodt

*Attorney, Agent, or Firm*—Thomas J. Morgan; Roderick B. Macleod

[57] ABSTRACT

An improved stuffer box crimper and a process employing such apparatus, the process involving feeding a tow of parallel filaments in the form of a sheet of constant thickness into a stuffer box crimper in which a primary crimp is imparted to the filaments by controlling the pressure against which the tow is delivered to the stuffer box and the secondary crimp is imparted to filaments by adjusting the denier per inch width at which the tow is delivered to the stuffer box, the imparted crimp being heat set by heating with a fluid while the tow is in the stuffer box.

2 Claims, 1 Drawing Figure

POLYESTER FIBERS AND TOWS

Figure 1:
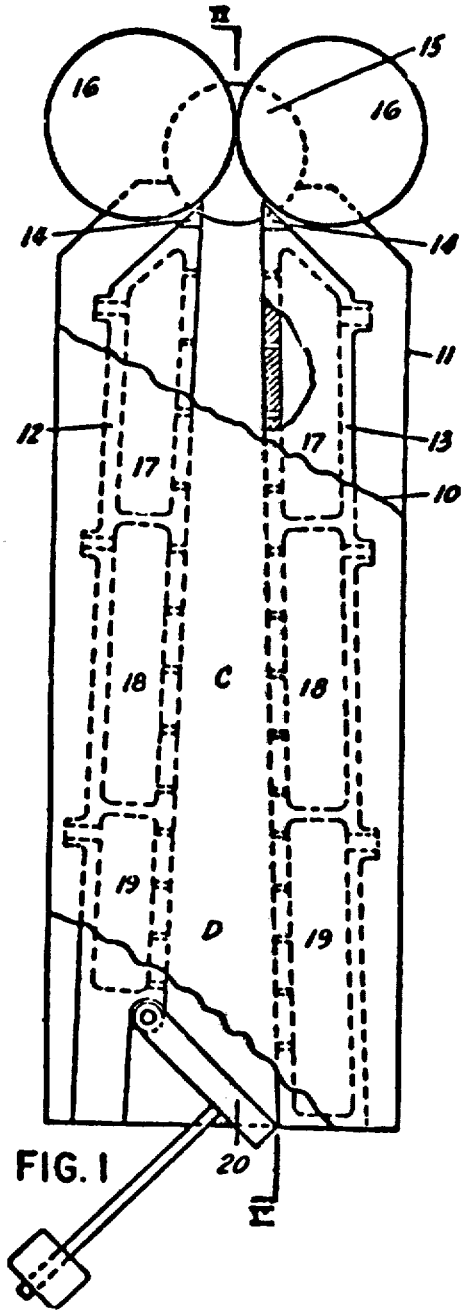

This is a continuation application of application Ser. No. 295,635 filed Oct. 6, 1972 which is a continuation application of application Ser. No. 100,489 filed Dec. 21, 1970 which is a continuation-in-part application of application Ser. No. 776,656 filed Nov. 18, 1968, all now abandoned.

This invention relates to improved crimped polyester staple fibers and tows and to an improved process and apparatus for their production.

Crimps introduced into fibers may be substantially planar in shape, and it is possible to form different crimps in different planes. When two planar crimps are introduced into a fiber, in substantially different planes, one with a higher frequency and lower amplitude and the other with a lower frequency and higher amplitude, these are referred to hereinafter as primary and secondary crimps respectively.

An important property of fibers is the ease with which they may be separated from each other so that during manufacture of yarns from tows or bales, groups of fibers do not remain continuously in contact or closely connected along their length and at their ends, but form an open and yet cohesive web of separated individual fibers. Another important property of fibers is the ease with which they may be converted from such an open web into a uniform spun yarn whether alone or blended with other fibers. A crimp which is not recovered to any significant extent after the fibers have been subjected to and released from a tension sufficient to straighten them, has little effect on their processability from tow or bale to web and yarn; whereas a heat set crimp which survives such tensions at least in part has an important influence on the processability of the fibers and the quality of derived yarns. A higher frequency single planar crimp in general promotes better openability and produces a more cohesive web. On the other hand a lower frequency crimp in general makes it easier to spin uniform yarns.

We have now found that, although a secondary crimp as hereinbefore defined has a lower frequency than a co-existing primary crimp, the openability of fibers is improved if there is present in the fiber a pronounced secondary crimp, provided this is sufficiently stable to be largely recovered after the fibers have been subjected to and released from a tension sufficient to straighten them. We have also found that when such a secondary crimp is present in the fibers, they have good openability, and provide uniform cohesive webs even when the frequency of the primary crimp is also low; and that fibers with both a pronounced and set secondary crimp and a low frequency and set primary crimp can readily be opened and processed into uniform webs and yarns.

Tows of filaments containing primary and secondary crimps may be made by known stuffer box processes arranged so that a primary crimp is first formed in the filaments in the plane of the tow as they are forced into the box by a pair of closely spaced rolls, and then the tow itself folds so as to impart to the filaments a secondary crimp in a plane substantially at right angles to the primary crimp. Further, still lower frequency, foldings may also be formed as the tow packs up under the crimping pressure to fill the box.

Filaments with stabilized crimp may also be made by known methods in which both crimping and heat treatment are done within an extended stuffer box containing both a crimping zone and a setting zone.

Known methods and apparatus for crimping filamentary tows are however not readily suited to producing low frequency and heat set primary and secondary crimps. We have found that when stuffer box crimpers are used it is difficult to produce a uniform and low frequency primary crimp if the filaments are significantly heated in the crimping zone and yet to make a fiber with heat set low frequency primary and secondary crimps it is very desirable to heat set the crimps, especially the secondary crimps, in the stuffer box before subsequent handling operations disturb them. Another difficulty is that a low crimping pressure is needed in a stuffer box to produce a low frequency primary crimp and in long stuffer boxes including a heat setting zone such low pressures are not easy to control because of frictional forces. A third problem is to provide means to control primary and secondary crimp frequencies independently. We have now found however that improved stuffer box design permits a process to be operated which readily produces fibers with low frequency and heat set primary and secondary crimps.

According to one aspect of this invention therefore we provide polyester filamentary tows, and staple fibers cut therefrom, characterized by a primary crimp with a frequency below 10 crimps per inch together with a secondary crimp with a frequency between 0.5 and 2.0 crimps per inch. Crimp frequencies are measured after pretensioning as described hereinafter. These fibers may possess normal percentages of crimp as defined hereinafter, but clearly if the percentage crimp is unusually low the full benefits of the invention are not achieved and we prefer a percentage crimp above 15% to which both primary and secondary crimps contribute significantly.

According to another aspect of this invention we provide an improved stuffer box crimping and heat setting process in which a tow of essentially parallel filaments in the form of a plane sheet of uniform and consistent thickness is fed into a stuffer box crimper in which a primary crimp imparted to the filaments is controlled by the pressure against which the tow is delivered into the stuffer box, a secondary crimp imparted to the filaments is controlled by adjusting the denier per inch width at which the tow is delivered into the stuffer box, and the tow is heated after crimping but while substantially undisturbed from the form into which it has been crimped and folded, by a heating fluid substantially none of which contacts the tow until after crimping and folding is completed According to yet another aspect of this invention we provide an improved stuffer box crimper, comprising a pair of co-operating feed rolls adapted to feed tow into one end of an enclosed chamber at the opposite end of which is an exit with a variable restriction adapted to control the pressure of tow within such chamber, characterized in that the chamber comprises a crimping zone adjacent to the rollers opening into a heat setting zone with cross-sectional dimensions greater than those of the crimping zone but sufficiently small so as to retain a column of tow essentially undisturbed from the crimped and folded form it assumes in the crimping zone, which heat setting zone is provided with means to admit a heating fluid to heat the tow and means to exhaust such heating fluid. Preferably the exhausting means serve to prevent heating fluid reaching the restricted exit as well as the feed rolls.

The values of crimp frequency quoted hereinbefore are measured in tows or staple fibers extracted from the package in which they are provided as a raw material for yarn manufacture. When measuring the crimps in a tow, a sample is first suspended from a clamp and subjected to a tension of 0.05 gm./denier for 60 seconds to straighten the tow, the tension is released for 10 seconds, and this cycle of operations is repeated three times to minimize any deformations that are quickly lost when the tow is simply straightened. When measuring the crimps in cut staple fibers, a sample of fibers is taken which forms a convenient bundle which can be gripped at its ends in such a way that each individual fiber is gripped at its ends, and the same cycles of loading and loading and unloading are applied. To measure the crimps the sample of tow or fibers is subjected for a fourth time to the tension of 0.05 gm./denier and two marks are made on the sample length L apart. The tension is then released and the number of primary crimps N and the number of secondary crimps n are counted in the marked length. The primary crimp frequency is expressed as N/L and the secondary crimp frequency is expressed as n/L. The percentage crimp in the filaments is the difference between the length L and the corresponding length $L_0$ when the tension is released, expressed as a percentage of $L_0$.

Table I illustrated the improved fibers of this invention by reference to fibers of polyethylene terephthalate with a denier of 1.5. Table II gives comparative results on fibers differing from the fibers of Table I only in their forms of crimp. All the fibers referred to in Tables I and II had a percentage crimp of about 35%.

Table I

| Crimps per inch Primary | Secondary | Fiber Openability | Web Cohesion | Yarn Uniformity |
|---|---|---|---|---|
| 7 to 8 | 0.5 | Moderate | Moderate | Good |
| 7 to 8 | 1.0 | Good | Good | Good |
| 7 to 8 | 2.0 | Good | Good | Moderate |
| 4 to 5 | 1.0 | Good | Good | Good |
| 7 to 8 | 1.0 | Good | Good | Good |
| 9 to 10 | 1.0 | Good | Good | Moderate |

Table II

| Crimps per inch Primary | Secondary | Fiber Openability | Web Cohesion | Yarn Uniformity |
|---|---|---|---|---|
| 5 | 0 | Very poor | Very poor | Moderate |
| 10 | 0 | Poor | Poor | Moderate |
| 15 | 0 | Poor | Moderate | Moderate |
| 20 | 0 | Moderate | Good | Poor |
| 15 | 1.0 | Good | Good | Poor |
| 20 | 1.0 | Good | Good | Poor |

Polyester fibers can suffer considerable loss of strength during caustic finishing treatments and this loss of strength can be more rapid when the fibers have been given a high frequency crimp. In the past it has not been possible to avoid this disadvantage of exaggerated loss of strength simply by reducing the frequency of the crimp because this seriously reduced the ease and efficiency with which the fibers could be processed into yarns. Table III illustrates an advantage of the fibers of this invention by reference to the caustic sensitivity of fibers of polyethylene terephthalate with intrinsic viscosities of 0.4 and 0.65, both types of fiber having a denier of 1.5 and a tenacity of 3 gm/denier.

These fibers were immersed for 15 minutes at 50°C. in a solution containing caustic soda at a concentration of 0.2 percent and sodium hydro-sulphite at a concentration of 0.2 percent. The tenacity of the fibers after this treatment is expressed as a fraction of their original tenacity. By way of comparison similar fibers with I.V.'s of 0.4 and 0.65 but with a primary crimp frequency of 14 crimps per inch retained only 0.50 and 0.83 of their original tenacities respectively after the same caustic treatment.

Table III

| Primary Crimp Frequency Crimps per inch | Secondary Crimp Frequency | Fraction of fiber tenacity retained after caustic treatment | |
|---|---|---|---|
| | | IV 0.4 | IV 0.65 |
| 2 | 1 | 1.0 | 1.0 |
| 4 | 1 | 0.99 | 0.99 |
| 6 | 1 | 0.96 | 0.96 |
| 8 | 1 | 0.88 | 0.93 |
| 10 | 1 | 0.76 | 0.90 |

The fibers of this invention referred to in Table I were made using the process and apparatus of this invention as explained below.

The control of secondary crimp frequency is illustrated in Table IV for fibers of polyethylene terephthalate with a denier of 1.5; the corresponding stuffer box pressure in each case being such as to give 7 crimps/inch of primary crimp.

| Secondary Crimp Frequency Crimps per inch | Tow density delivered to stuffer box; denier per inch width |
|---|---|
| 2.0 | 90,000 |
| 1.0 | 140,000 |
| 0.5 | 290,000 |

To make fibers with higher or lower primary crimp frequencies the stuffer box pressure is increased or decreased in the usual way and then a slight correction may be needed to the tow density to re-establish the required secondary crimp frequency. The tow densities and pressures needed to produce any required combination of crimps will also depend slightly on the antistatic and lubricant previously applied to the tow.

Different fibers require different minimum heat setting treatments to stabilize the crimp sufficiently to meet the requirements of this invention. For instance, fibers of polyethylene terephthalate with a tenacity of about 4–5 gm./denier and a crystallinity of about 15 percent need only about 1 second in steam; but fibers of polyethylene terephthalate with a tenacity of about 6–7 gm./denier and a crystallinity of about 35 percent need longer. This time is, however, conveniently made longer than the minimum time required to stabilize the crimp, because the length of the setting zone is conveniently chosen to provide also a simple means for conveying the tow to a subsequent processing stage such as further heat treatment or cutting or tow packaging.

It is important to handle the tow issuing from the stuffer box in such a way that it is allowed to cool before applying any significant tension. The cooling required will depend on the type of fiber, and if it is inadequate the resultant percentage crimp will be reduced. Tows of polyethylene terephthalate of example should be allowed to cool below 70°C. and preferably below 40°C. before applying enough tension to straighten out the crimped shape. The fibers referred to in Table I were withdrawn from the stuffer box without cooling but kept under very low tension until they had cooled to 40°C. and they had a percentage crimp of about 35 percent. Careful handling out of the stuffer box and the use of a lubricant dressing which permitted lower crimper pressures permitted the production of fibers with 45 percent crimp with some benefit in sliver strength and yarn quality but when tension at the stuffer box exit was permitted to rise a little so that the percentage crimp fell to 20% there was no significant deterioration in processability or yarn quality. When fibers with only 15% crimp were made by using a still higher tension at the stuffer box exit, they had a significantly poorer processability.

Figure 2:
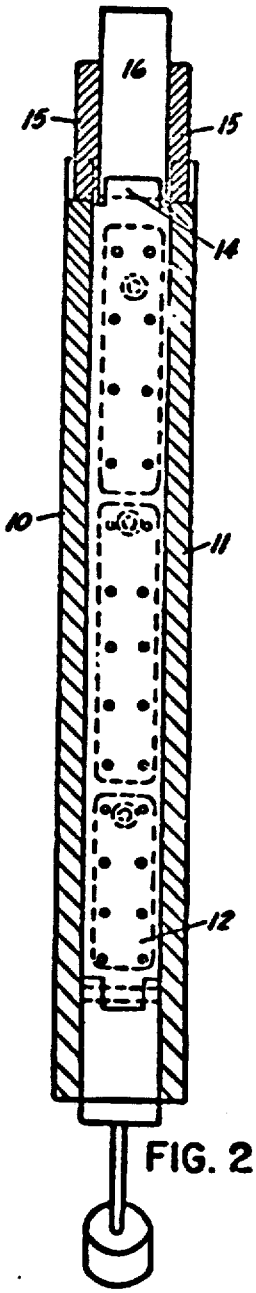

The crimped tow emerging from the stuffer box may be subjected to a drying process or a second heat setting process. A second heat setting process in the absence of any applied pressure or constraint may be used to increase still further the stability of the crimp shape against tensile loading and unloading cycles at higher tensions than those used in the test described hereinbefore. Preferred apparatus for carrying out the process of this invention will now be described by way of example with reference to the accompanying drawing in which FIG. 1 illustrates the apparatus in the plane of the delivery rolls and FIG. 2 is a section along the line II — II of FIG. 1.

A stuffer box is formed by front and back plates 10 and 11, and a pair of side members 12 and 13 which end in a pair of scraper blades 14. These blades fit between two discs 15 and closely approach a pair of driven delivery rolls 16 which are also closely spaced with respect to each other and the discs 15. The side members 12 and 13 each contain three chambers 17, 18 and 19 connected by ports to the interior of the stuffer box. The chambers 17 and 19 are connected by ports to a supply of heating fluid. The side plate 12 supports a loaded door 20 which bears against the member 13 to close the bottom of the stuffer box.

In operation of tow of filaments is presented at a controlled denier per inch width to the delivery rolls and is forced by them into a first zone of the stuffer box A. Crimping and folding take place in this zone so that a close packed rectangular column of tow moves from the zone A to a zone B with primary crimp in the plane of FIG. 2 and secondary crimp in the plane of FIG. 1. The width of the stuffer box increases from the distance between the inner faces of the discs 15 in zone A to the distance between the inner faces of the plates 10 and 11 in zone B. This increases in width relieves the later pressure on the column of tow so that it is allowed to buckle slightly while transmitting pressure generated between the loaded door 20 and the driven delivery rolls 16. The buckling must be not so much as substantially to disturb the crimps formed in the filaments, but sufficient to reduce friction with the box walls far enough so that the pressure generated at the loaded door 20 can be used to control the crimping pressure in the zone A.

The members 12 and 13 are also slightly divergent to assist in minimizing friction between the town and the box walls in zone B, C and D.

Steam is introduced through chambers 18 into a zone C to heat the tow and stabilize the crimp. Although the tow is slightly buckled and only in occasional friction contact with the walls 10 and 11, the spaces so formed must not be so great as to let the steam travel along the box without penetrating and heating the tow.

Steam is exhausted from the tow in zones B and D through chambers 17 and 19 so that it does not significantly penetrate into zone A or past the loaded door 20.

Many modifications of this apparatus may be used to perform the process and make the product of this invention. For instance, the increase in box width between zones A and B may be provided in different ways, such as providing a step in the inner faces of members 10 and 11; the discs 15 could be of various shapes; different door loading systems may be used to control the crimping pressure and the zone D may be dispensed with. The length and divergence of the members 12 and 13, and the increase in box width between zones A and B, will depend on the type and weight of the tow in use and on the dimensions of the delivery rolls, and may be varied considerably, so long as adequate pressure and crimp control are retained, and so long as adequate heating and exhausting are provided, so that the fibers of this invention may be produced.

What is claimed:

1. An improved process for preparing a tow of crimped filaments with each filament having a primary crimp and a secondary crimp in a plane substantially at right angles to the primary crimp, by feeding a tow of parallel filaments into a stuffer box crimper and heat setting with a fluid while the tow is in the stuffer box, and by controlling the frequency of the primary crimp by controlling the pressure against which the tow is delivered to the stuffer box to yield a primary crimp frequency of 4 to 10 crimps per inch, wherein the improvement comprises:

adjusting said tow's denier per inch of width at said tow's delivery point to said stuffer box crimper, until said tow and filaments have a secondary crimp of between 0.5 and 2.0 crimps per inch and a percentage crimp of greater than 15%, whereby staple fibers made therefrom have good fiber openability, good cohesion in webs and good uniformity in yarns.

2. The process of claim 1 which comprises adjusting polyethylene terephthalate tow between 75,000 and 300,000 denier per inch width.

* * * * *